US006062682A

United States Patent [19]

Ahn

[11] Patent Number: 6,062,682

[45] Date of Patent: May 16, 2000

[54] METHOD FOR HOMOGENIZING A PIGMENT INK CONTAINED IN AN INK CARTRIDGE MOUNTED IN AN INK JET PRINTER

[75] Inventor: Byung-Sun Ahn, Suwon, Rep. of Korea

[73] Assignee: Samsung Electronics Co., Ltd., Suwon, Rep. of Korea

[21] Appl. No.: 08/929,469

[22] Filed: Sep. 15, 1997

[30] Foreign Application Priority Data

Sep. 16, 1996 [KR] Rep. of Korea ..... 96-40193

[51] Int. Cl.[7] ..... B41J 2/17

[52] U.S. Cl. ..... 347/85; 347/86

[58] Field of Search ..... 347/85, 84, 86, 347/87, 89, 91

[56] References Cited

U.S. PATENT DOCUMENTS

| | | |
|---|---|---|
| 4,050,075 | 9/1977 | Hertz et al. . |
| 4,433,341 | 2/1984 | Thomas . |
| 4,456,916 | 6/1984 | Kocot . |
| 4,527,175 | 7/1985 | Kojima et al. . |
| 4,577,197 | 3/1986 | Crean et al. . |
| 4,973,980 | 11/1990 | Howkins . |
| 5,448,274 | 9/1995 | Hirabayashi et al. . |
| 5,451,987 | 9/1995 | Perrin . |

FOREIGN PATENT DOCUMENTS

| | | |
|---|---|---|
| 0 307 160 A2 | 3/1989 | European Pat. Off. . |
| 0 307 160 A3 | 3/1989 | European Pat. Off. . |

OTHER PUBLICATIONS

Patent Abstracts of Japan, vol. 102 No. 227 (M–713), Jun. 28, & JP 63 022655 A (Ricoh Co Ltd).

Patent Abstracts of Japan, vol. 016, No. 563 (M–1342), Dec. 4, 1992 & JP 04 216940 A (Seiko Epson Corp), Aug. 7, 1992.

Patent Abstracts of Japan, vol. 010, No. 096 (M–469), Apr. 12, 1986 & JP 60 232962 a (Canon KK), Nov. 19, 1985; and.

Patent Abstracts of Japan, vol. 009, No. 264 (M–423), Oct. 22, 1985 & JP 05 338 195 A (Seiko Epson Corp), Dec. 21, 1993.

*Primary Examiner*—Richard Moses

*Attorney, Agent, or Firm*—Robert E. Bushnell, Esq.

[57] ABSTRACT

A method for homogenizing pigment ink contained in an ink cartridge mounted to move along a carrier shaft of an ink jet printer is characterized by the step of driving the ink cartridge at least once along the carrier shaft so as to stir the pigment ink into a uniform mixture. In further embodiments of the invention, driving of the ink cartridge and stirring of the pigment ink take place before performance of printing and/or nozzle cleaning operations when printing and/or nozzle cleaning commands are issued.

9 Claims, 4 Drawing Sheets

METHOD FOR HOMOGENIZING A PIGMENT INK CONTAINED IN AN INK CARTRIDGE MOUNTED IN AN INK JET PRINTER

CLAIM OF PRIORITY

This application makes reference to, incorporates the same herein, and claims all benefits accruing under 35 U.S.C. § 119 from an application for METHOD FOR HOMOGENIZING A PIGMENT INK CONTAINED IN AN INK CARTRIDGE MOUNTED IN AN INK JET PRINTER earlier filed in the Korean Industrial Property Office on the 16$^{th}$ of September 1996 and there duly assigned Ser. No. 40193/1996.

BACKGROUND OF THE INVENTION

1. Technical Field

The present invention relates to an ink jet printer, and more particularly a method for cleaning the nozzle of an ink cartridge mounted in an ink jet printer.

2. Related Art

Generally, an ink jet printer includes a carrier motor for driving an ink cartridge provided with a print head. The ink cartridge is driven by a timing belt carried on a driving pulley rotated by the carrier motor. Thus, the ink cartridge is driven by the carrier motor.

Such arrangements are disclosed in the following patents: U.S. Pat. No. 4,050,075 to Hertz et al., entitled Ink Jet Method And Apparatus, U.S. Pat. No. 4,433,341 to Thomas, entitled Ink Level Control For Ink Jet Printer, U.S. Pat. No. 5,448,274 to Hirabayashi et al., entitled Ink Jet Recording Apparatus And Carriage Mechanism Therefor, U.S. Pat. No. 5,451,987 to Perrin, entitled Ink Circuit Particularly Intended To Pressurize A Pigment Ink For An Ink Jet Printer, U.S. Pat. No. 4,456,916 to Kocot, entitled Ink Jet Cartridge With Hydrostatic Controller, U.S. Pat. No. 4,527,175 to Kojima et al., entitled Ink Supply System For Nonimpact Printers, and U.S. Pat. No. 4,577,197 to Crean et al., entitled Ink Jet Printer Droplet Height Sensing Control.

In ink jet printers, the ink cartridge contains pigment ink which consists of a pigment and liquid. The pigment ink is jetted out through the nozzle of the print head of the cartridge during a print operation or when cleaning the nozzle. The cleaning of the nozzle is such that, when the power is on, the pigment ink within the nozzle is jetted out so as to prevent the nozzle from clogging. When cleaning the nozzle, the jetted amount of the pigment ink is usually 100–200 drops.

The weight of the pigment ink is heavier than that of the liquid. Therefore, when the power is off, or when power is left on without printing, the pigment part of the pigment ink settles to the bottom.

When considering the pigment part sunk to the bottom of the ink cartridge, the lower part of the ink cartridge is occupied by pigment deposited on the bottom, and the upper part is occupied by the liquid serving as the carrier. Hence, in this state of the cartridge, if the pigment ink is jetted out to print or clean the nozzle, more pigment is contained in the jetted portion of the pigment ink than is the case in the normal state of the cartridge because the print head is mounted on the lower part of the cartridge. If the printing or nozzle cleaning operation is repeated in this state, the density of the pigment becomes thinner, that is, the pigment content is reduced. Accordingly, the quality of the printed images deteriorates, resulting in an early replacement of the ink cartridge. Furthermore, when the pigment is deposited to the bottom, the print head can not perform the printing and nozzle cleaning operations normally because of insufficient carrier liquid, making the nozzle clog.

Elaborate and expensive solutions to this problem have been proposed. For example, previously mentioned U.S. Pat. No. 5,451,987 to Perrin provides magnetic agitators at the base of reservoirs to prevent settling of pigment. However, such an arrangement complicates matters and adds unnecessary expense to the cost of manufacturing the ink-jet printer.

SUMMARY OF THE INVENTION

It is an object of the present invention to provide a method for homogenizing pigment ink contained in an ink cartridge of an ink jet printer during a printing or head cleaning operation.

To accomplish the above object, the present invention comprises a method for homogenizing a pigment ink of an ink jet printer having an ink cartridge, a motor for driving the ink cartridge to the right and left, and a controller for controlling an instrument having the motor. In accordance with the invention, the pigment ink contained in the ink cartridge is stirred by driving the ink cartridge to the right and left under the influence of the motor as driven by the controller.

The present invention will now be described more specifically with reference to the drawings attached only by way of example.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

and

Figure 4:
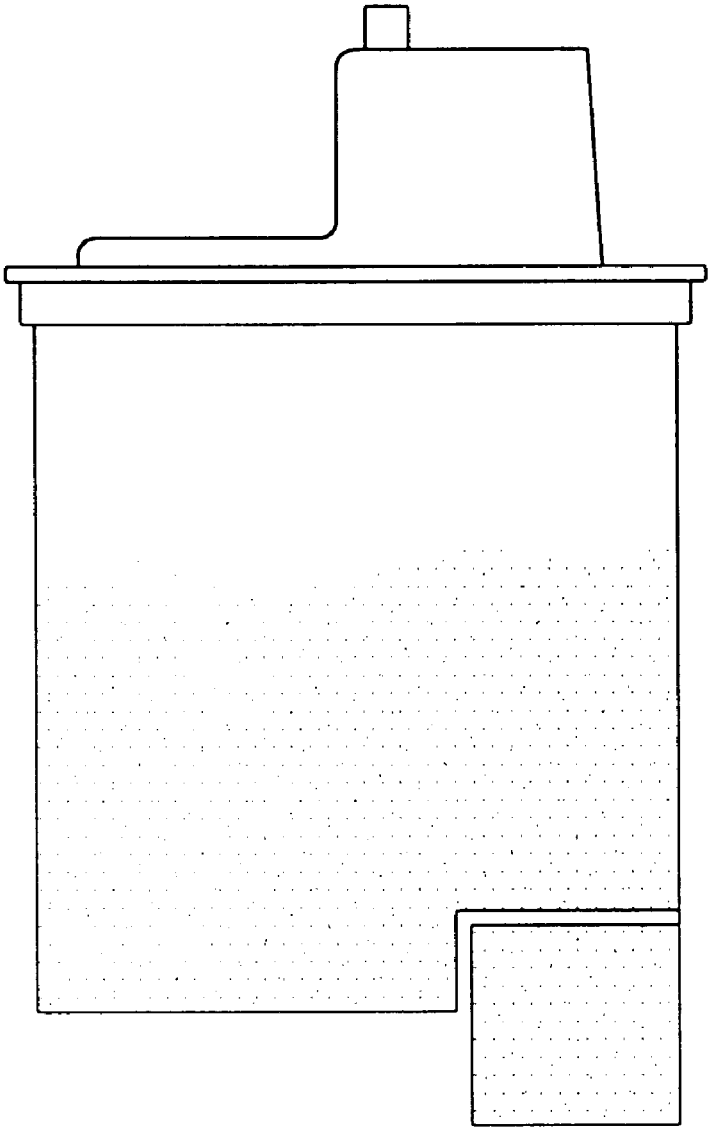

FIG. 4 is a diagram illustrating the homogeneous state of pigment ink in an ink cartridge.

Figure 5:
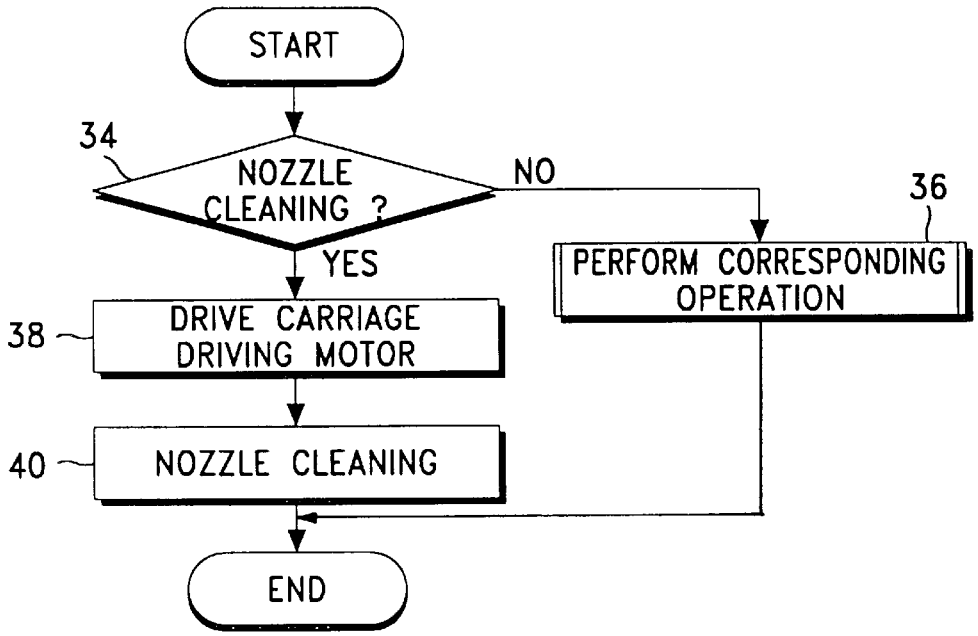
Figure 6:
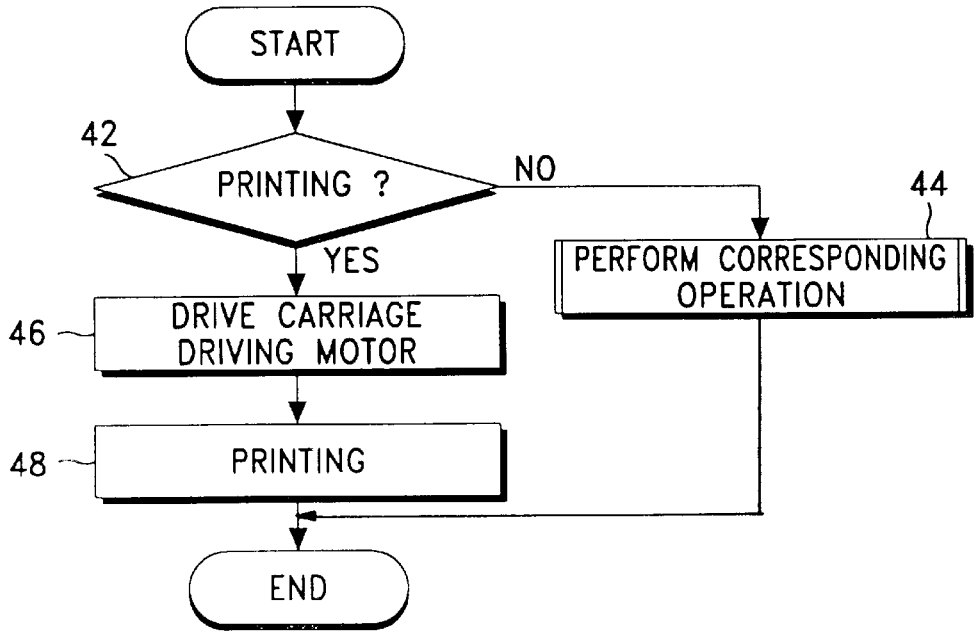

FIG. 5 is a flow chart illustrating a process for homogenizing a pigment ink contained in an ink cartridge mounted in an inkjet printer according to a second preferred embodiment of the present invention; and FIG. 6 is a flow chart illustrating a process for homogenizing a pigment ink contained in an ink cartridge mounted in an ink jet printer according to a third preferred embodiment of the present invention.

DETAILED DESCRIPTION OF THE PREFERRED EMBODIMENT

Figure 1:
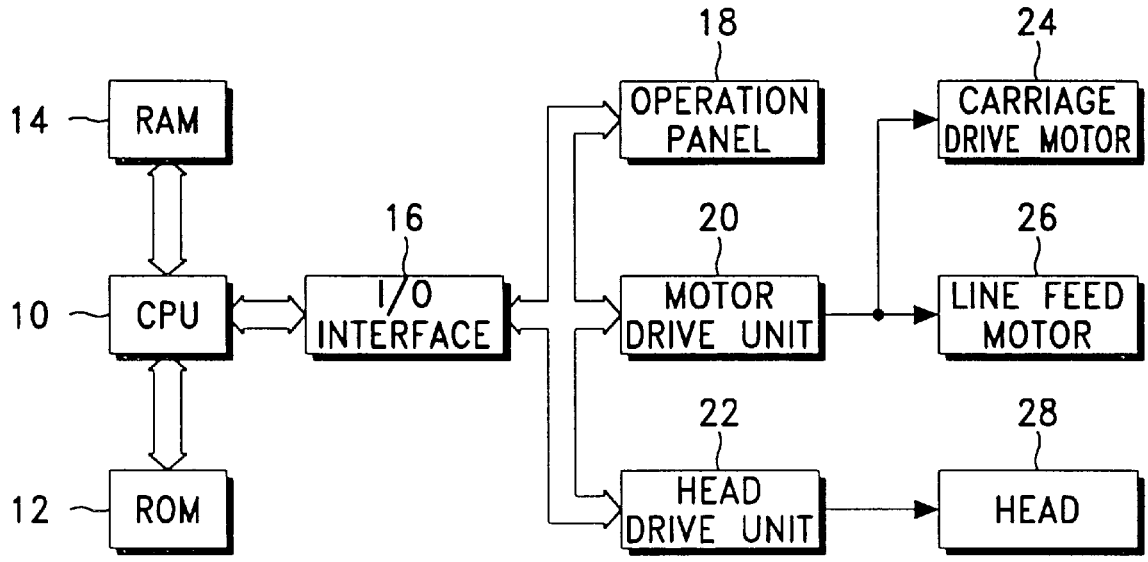
PRIOR ART FIG. 1
FIG. 1 is a block diagram of a conventional ink jet printer.

Referring to FIG. 1, the central processing unit (CPU) 10 executes the program stored in the read-only memory (ROM) 12, thereby controlling all the component parts of the ink jet print device via the input/output (I/O) interface 16. The ROM 12 stores the executive program and various initial data of the CPU 10. The random-access memory (RAM) 14 temporarily stores the data resulting from the operations of the CPU 10. The I/O interface 16 interfaces communication signals between the CPU 10 and the I/O devices, i.e., the operation panel 18, the motor drive unit 20, and the head drive unit 22. The operation panel 18 comprises a plurality of keys for entering various instructions into the CPU 10 and a display device for displaying various states of the print device under the control of the CPU 10. The motor drive unit 20 drives the carriage drive motor 24 and the linefeed motor 26 under the control of the CPU 10. The carriage drive motor 24 is actuated by the motor drive unit 20, thereby moving the head cartridge (not shown in drawings). The line feed motor 26 is actuated by the motor drive unit 20, thereby feeding a recording medium, such as paper. The head drive unit 22 drives the print head 28 under the control of the CPU 10, thereby jetting out pigment ink through the nozzle (not shown) provided on the print head 28 to print images on the recording medium.

Figure 2:
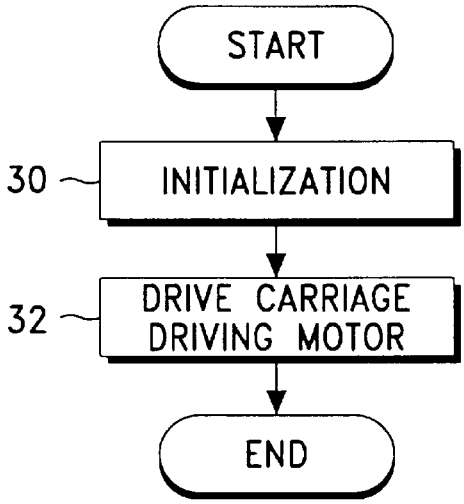
FIG. 2 is a flow chart for illustrating a process homogenizing pigment ink contained in an ink cartridge mounted in an inkjet printer according to a first preferred embodiment of the present invention.
Figure 3:
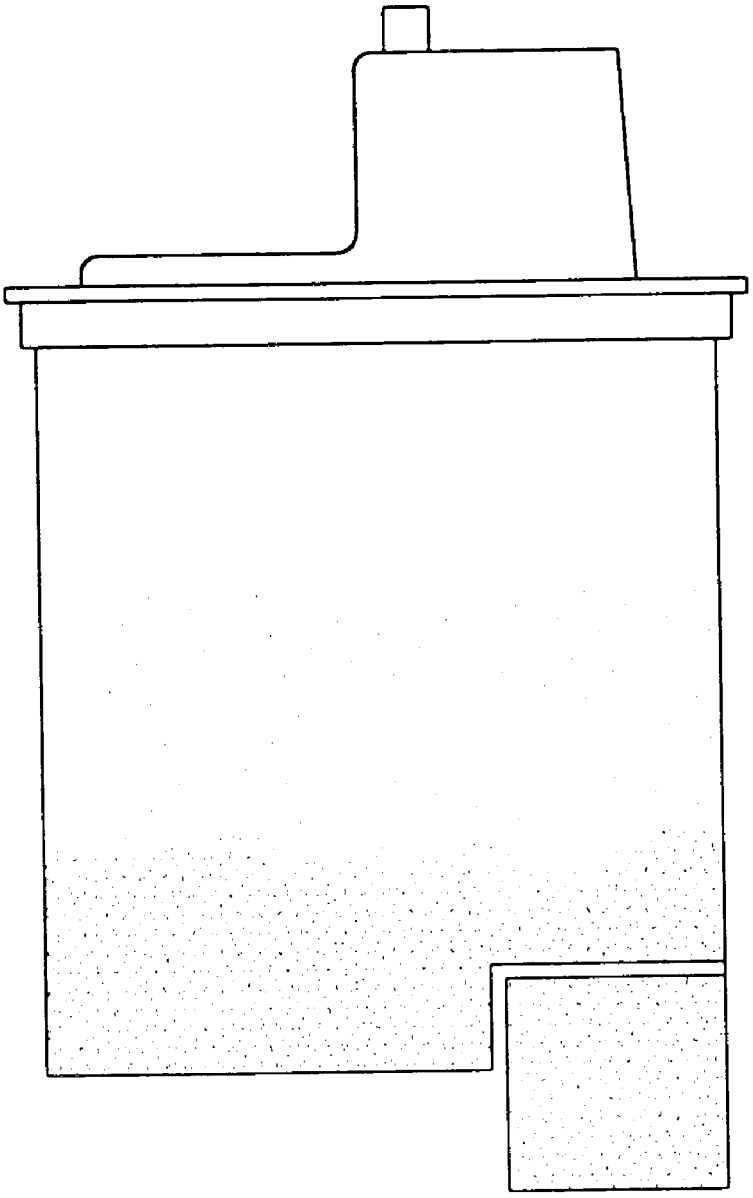
FIG. 3 is a diagram illustrating the non-homogeneous state of pigment ink in an ink cartridge.

Referring to FIG. 2, when the printer is turned on, the CPU 10 initalizes (step 30) and instructs the motor drive unit 20 to drive the carriage drive motor 24. Then, in step 32, the carriage drive motor 24 is driven so as to make the ink cartridge reciprocate once along the carrier shaft, and the pigment ink is stirred in the ink cartridge to make the pigment ink homogenized in the ink cartridge, as shown in FIG. 4. This is in contrast to the non-homogenized state shown in FIG. 3. After the carriage drive motor 24 has completed a round of reciprocating movement in step 32, the CPU 10 proceeds to clean the nozzle by jetting out the pigment ink in order to prevent it from clogging. Once this is completed, the procedure is terminated.

As illustrated above, since the ink cartridge is moved to the right and left after the initialization is performed by the power supply being turned on, a pigment component and a carrier component of the pigment ink contained in the ink cartridge are stirred and homogenized.

Referring to FIG. 4 illustrating the state of the pigment ink in the ink cartridge after moving the ink cartridge to the right and left as above, the pigment ink of the ink cartridge is entirely homogenized.

Referring to FIG. 5, which illustrates a process for homogenizing the pigment ink contained in the ink cartridge according to another preferred embodiment of the present invention, in step 34, the CPU 10 checks whether a nozzle cleaning command is provided. If the nozzle cleaning command is provided, the nozzle cleaning is performed, in step 40, after the ink cartridge is moved to the right and left along the carrier shaft, in step 38, by driving the carriage driving motor. If not, a corresponding operation is performed (step 36), and then the procedure is terminated.

Referring to FIG. 6, which illustrates a process for homogenizing the pigment ink contained in the ink cartridge according to a further preferred embodiment of the present invention, in step 42, the CPU 10 checks whether a printing command is provided. If the printing command is provided, printing is performed, in step 48, after moving the ink cartridge to the right and left along the carrier shaft, in step 46, by driving the carriage driving motor. If not, a corresponding operation is performed (step 44), and then the procedure is terminated.

As illustrated above, the present invention prevents pigment ink having a high ratio of pigment component from being jetted out in a next operation by homogenizing the pigment ink contained in the ink cartridge after the initialization of the controller is performed. Also, the present invention prevents the nozzle from being clogged by homogenizing the pigment ink contained in the ink cartridge even at the time of the nozzle cleaning, thereby maintaining a sufficient carrier component. Furthermore, the present invention prevents pigment ink having a high ratio of pigment component from being jetted out at the time of printing by homogenizing the pigment ink contained in the ink cartridge prior to printing despite the existence of non-homogeneous pigment ink caused by lack of printing for a long time.

As illustrated above, the present invention has advantages in that pigment ink having a high ratio of pigment component are jetted out to prevent the density of the pigment ink from being lowered by homogenizing the pigment ink contained in the ink cartridge at the time of printing. In addition, nozzle clogging is prevented by jetting out the homogeneous pigment ink at the time of nozzle cleaning.

Although the present invention has been described in connection with a specific embodiment accompanying the attached drawings, it will be readily apparent to those skilled in the art that various modifications and changes may be made thereto without departing the gist of the present invention.

What is claimed is:

1. A method for homogenizing pigment ink contained in an ink cartridge of an ink jet printer, comprising the steps of:

providing said ink jet printer with a carrier shaft;

mounting said ink cartridge on said carrier shaft;

detecting turn on of said ink jet printer; and driving said ink cartridge forward and backward at least once along said carrier shaft so as to stir said pigment ink into a uniform mixture;

said method further comprising the step, prior to said driving step, of performing an initialization operation.

2. A method as defined in claim 1, further comprising the step, after said driving step, of performing a printing operation if a printing command is issued.

3. A method as defined in claim 1, further comprising the step, after said driving step, of performing a nozzle cleaning operation.

4. A method, for homogenizing pigment ink contained in an ink cartridge of an ink jet printer, comprising the steps of:

providing said ink jet printer with a carrier shaft;

mounting said ink cartridge on said carrier shaft;

detecting turn on of said ink jet printer; and driving said ink cartridge forward and backward at least once along said carrier shaft so as to stir said pigment ink into a uniform mixture;

said method further comprising the step, after said driving step, of performing a nozzle cleaning operation.

5. A method as defined in claim 4, further comprising the step, prior to said driving step, of performing an initialization operation.

6. A method for homogenizing pigment ink having a pigment portion and a liquid portion contained in an ink cartridge mounted to move along a carrier shaft of an ink jet printer under the influence of a carriage drive motor, comprising the steps of: detecting a print command;

driving the carriage drive motor to move the ink cartridge along the carrier shaft so as to stir said pigment ink to homogenize the pigment and liquid portions in response to the print command;

jetting out said pigment ink through a nozzle of said ink cartridge so as to prevent the nozzle from clogging after completing the driving of said carriage drive motor; and performing a print operation according to a prescribed procedure after completing said jetting out of said pigment ink.

7. A method as defined in claim 6, wherein the step of driving said carriage drive motor comprises reciprocating said ink cartridge forward and backward at least once along said carrier shaft.

8. A method for homogenizing pigment ink having a pigment portion and a liquid portion contained in an ink cartridge mounted to move along a carrier shaft of an ink jet printer under the influence of a carriage drive motor, comprising the steps of:

detecting a nozzle cleaning command;

driving the carriage drive motor to move the ink cartridge along the carrier shaft so as to stir said pigment ink to homogenize the pigment and liquid portions in response to the nozzle cleaning command;

jetting out said pigment ink through a nozzle of said ink cartridge so as to prevent the nozzle from clogging after completing the driving of said carriage drive motor; and performing a nozzle cleaning operation according to a prescribed procedure after completing said jetting out of said pigment ink.

9. A method as defined in claim 8, wherein the step of driving said carriage drive motor comprises reciprocating said ink cartridge forward and backward at least once along said carrier shaft.

* * * * *